US007240799B2

(12) United States Patent
Zhang

(10) Patent No.: US 7,240,799 B2
(45) Date of Patent: Jul. 10, 2007

(54) FOLDABLE CONTAINER

(76) Inventor: Zhi Qiang Zhang, #806, Block 4, Airong Yuan, Shekou Industrial District, ShenZhen, Guangdong (CN)

( * ) Notice: Subject to any disclaimer, the term of this patent is extended or adjusted under 35 U.S.C. 154(b) by 226 days.

(21) Appl. No.: 11/020,704

(22) Filed: Dec. 21, 2004

(65) Prior Publication Data

US 2005/0139510 A1 Jun. 30, 2005

(30) Foreign Application Priority Data

Dec. 29, 2003 (CN) ..... 2003 1 0121002

(51) Int. Cl.
*B65D 19/00* (2006.01)

(52) U.S. Cl. ..... 206/600; 220/4.28; 220/6

(58) Field of Classification Search ..... 206/600, 206/389, 598; 220/4.28–4.34, 1.5, 6, 7; 108/53.1
See application file for complete search history.

(56) References Cited

U.S. PATENT DOCUMENTS 3,514,030 A * 5/1970 Carroll ..... 206/599
3,735,713 A * 5/1973 Glassmeyer ..... 108/53.5
4,638,744 A * 1/1987 Clive-Smith ..... 108/56.1
5,036,979 A * 8/1991 Selz ..... 206/512
5,161,709 A * 11/1992 Oestreich, Jr. ..... 220/6
5,253,763 A * 10/1993 Kirkley et al. ..... 206/600
5,415,311 A * 5/1995 Coogan ..... 220/6
5,564,599 A * 10/1996 Barber et al. ..... 222/105
2002/0139798 A1* 10/2002 Logan et al. ..... 220/7
2003/0150769 A1* 8/2003 Lau ..... 206/600

* cited by examiner

*Primary Examiner*—Mickey Yu
*Assistant Examiner*—Steven A. Reynolds
(74) *Attorney, Agent, or Firm*—Raymond Y. Chan; David and Raymond Patent Group

(57) ABSTRACT

A foldable container includes a base panel and a pair of folding panels coupled with the base panel via a folding device, wherein the folding device includes a first load-carrying arrangement positioned on the base panel and a second load-carrying arrangement provided at the folding panels. The first load-carrying arrangement and the second load-carrying arrangement are pivotally connected to ensure the folding panels being folded with respect to the base panel so as to reduce the volumetric space of the container. Since the second load-carrying arrangement is adapted for withstanding substantial force, the foldable container is adapted to be moved by conventional hangers and stacked in a convenient manner.

18 Claims, 20 Drawing Sheets

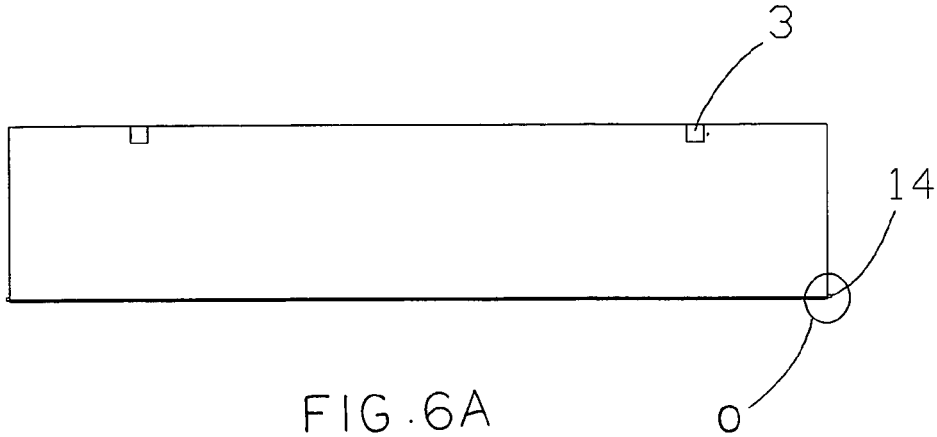
FIG. 6A
FIG. 6C
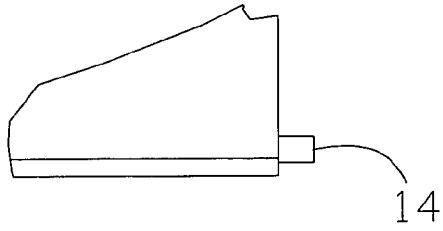
FIG. 6B

FOLDABLE CONTAINER

BACKGROUND OF THE PRESENT INVENTION

1. Field of Invention

The present invention relates to a container, more particularly, relates to a foldable container.

2. Description of Related Arts

Conventionally, there are two types of foldable containers are widely used, wherein the first type of foldable container comprising a plurality of irregular panels disassembling with each other and the second type of foldable container comprising two side panels and a base panel. Accordingly, the first type of foldable container causes substantial waste on labor, stuff, time, thus rocketing the transporting costs of such containers because the assembling process is complicated and time consuming. For the second type of containers, it is impossible to enclose a sealed space, therefore merely applicable for transporting some special cargos. In addition, some reclusive hanging or hoisting equipment would be utilized for moving such open-style containers. That is to say, the special hanger would be a prerequisite for moving such containers, instead of using traditional ceiling-suspending equipments. Furthermore, such foldable containers are vulnerable to the weather condition such as the corrosion of rain and sea water. Chinese patent 96236835.0 discloses a foldable container having above mentioned problems. In addition, since most of the lifting holes of the container are collected on the base panel, while the top panels are coupled with the side panels by conventional fastening means, so that the top panel can not bear intensive force. In short, due to the fact of above mentioned shortcomings and problems, the conventional foldable containers are not suitable to be conveniently transported and stacked with an industrial scale, or adaptive to simplify the loading and unloading process. Undoubtedly, such foldable containers have been eliminated from the land and sea transportation industry.

SUMMARY OF THE PRESENT INVENTION

A primary object of the present invention is to provide a foldable container having an easier and convenient structure, so as to overcome the shortcomings of the conventional foldable containers.

In order to achieve the above object, the present invention provides a foldable container, comprising a base panel and two folding panels, and a folding arrangement pivotally coupled the two folding panels with two sides of the base panel respectively, wherein the folding arrangement comprises a first load-carrying structure and a second load-carrying structure, the first load-carrying structure is disposed on the base panel, and the second load-carrying structure is arranged at the folding panel, wherein the first load-carrying structure and the second load-carrying structure are pivotally coupled or otherwise respectively and pivotally coupled to a third load-carrying member.

According to the present invention, the first load-carrying structure, the second load-carrying structure and the third load-carrying member are prepared with a continuous and elongated structure, or at least have two discrete portions.

As a result, the load-carrying member disposed on the folding panel is capable of being folded with respect to the base panel, so that the volume of the container could be significantly reduced. On the other hand, when the load-carrying member is unfolded, the container is unfolded as well. Since the load-carrying member is capable of withstanding substantial force and transferring such substantial force, the full loaded container could be hanged by hoisting means, and more importantly, could be overlappedly disposed to form a container stack.

Furthermore, since the load-carrying member is defined as a continuous and elongated structure, or defined as discretely separated parts, the force-bear area of the load-bearing member will be increased, so that the sizes of such coupling part could be reduced, and the thickness of the base panel and folding panel could be reduced as well.

These and other objectives, features, and advantages of the present invention will become apparent from the following detailed description, the accompanying drawings, and the appended claims.

BRIEF DESCRIPTION OF THE DRAWINGS

FIG. 6A is front view of the sub-panel E of the side panel of the present invention.

FIG. 6B is partially enlarged view showing the sub-panel E of the side panel of the present invention.

FIG. 6C is a left view of the sub-panel E of the side panel of the present invention.

DETAILED DESCRIPTION OF THE PREFERRED EMBODIMENT

Figure 1A:
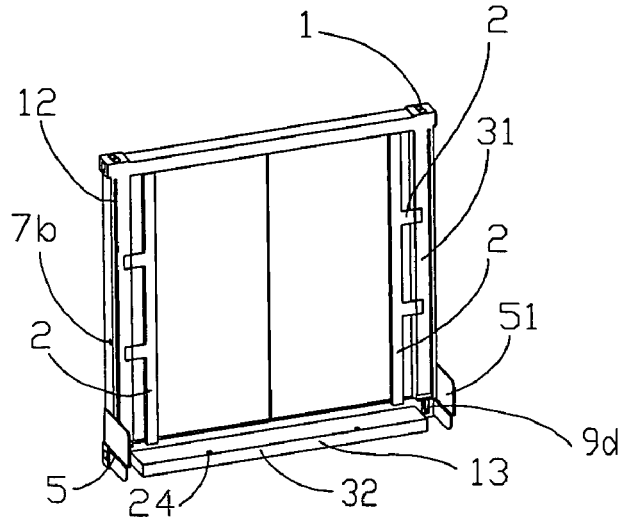
FIG. 1A is a perspective view of the folding panel in an unfolding first position according to the preferred embodiment of the present invention.
Figure 1B:
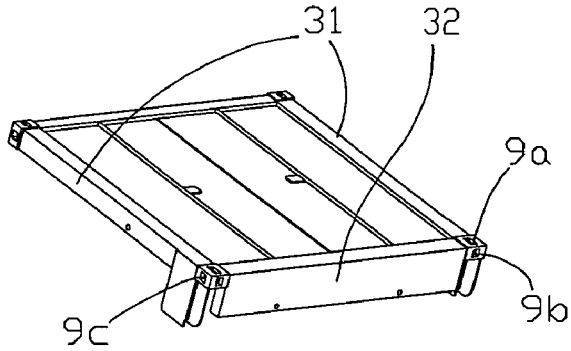
FIG. 1B is another perspective view of the folding panel in the unfolding position according to the preferred embodiment of the present invention.
Figure 1C:
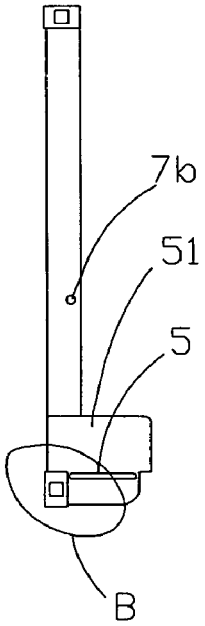
FIG. 1C is a left view of the folding panel in the unfolding position according to the preferred embodiment of the present invention.
Figure 1D:
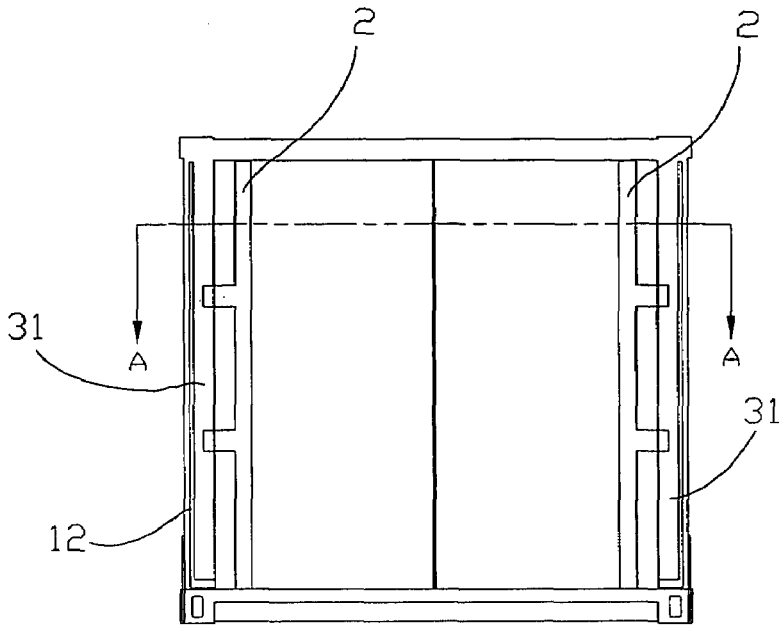
FIG. 1D is a front view of the folding panel in the unfolding position according to the preferred embodiment of the present invention.
Figure 1E:
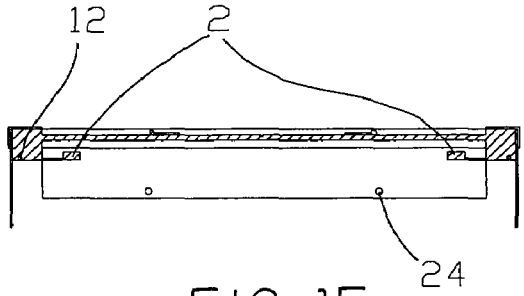
FIG. 1E is a sectional view showing the folding panel in the unfolding position according to the preferred embodiment of the present invention.
Figure 1F:
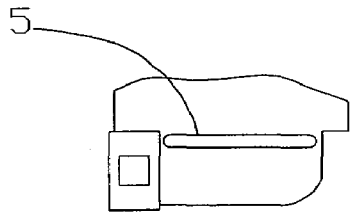
FIG. 1F is partially enlarged perspective view of the folding panel in the unfolding position according to the preferred embodiment of the present invention.
Figure 2A:
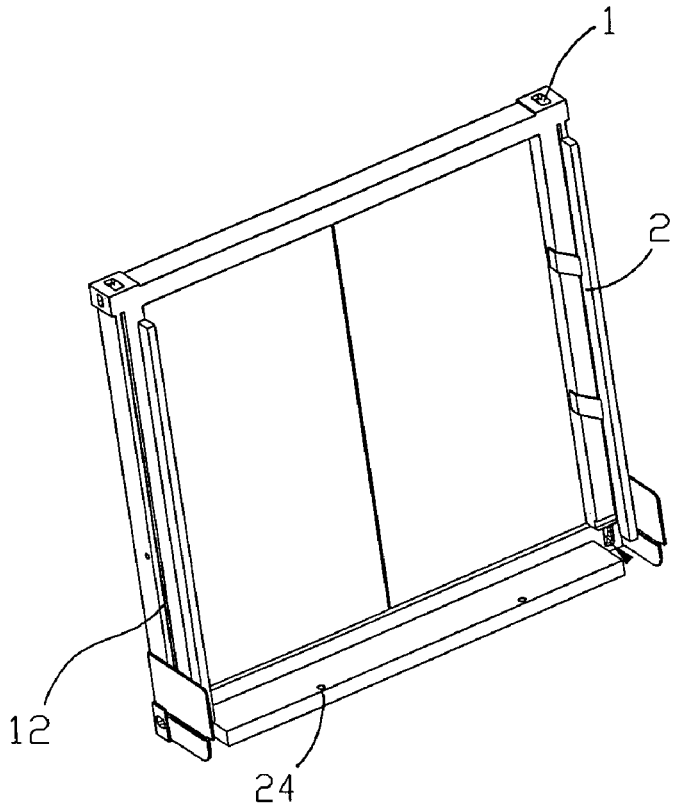
FIG. 2A is a perspective view of the folding panel according to the preferred embodiment of the present invention.
Figure 2B:
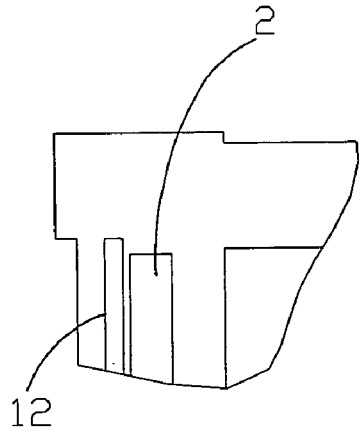
FIG. 2B is a partially enlarged perspective view showing the folding panel in a second position according to the preferred embodiment of the present invention.
Figure 2C:
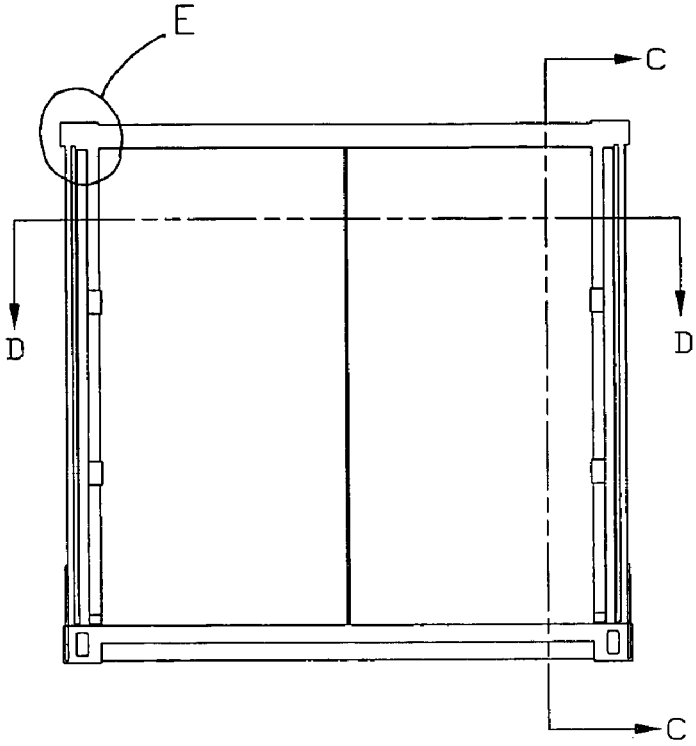
FIG. 2C is a front view of the folding panel in a second position according to the preferred embodiment of the present invention.
Figure 2E:
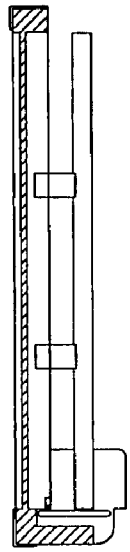
FIG. 2E is a E—E sectional view illustrating the folding panels in a second position according to the preferred embodiment of the present invention.
Figure 2D:
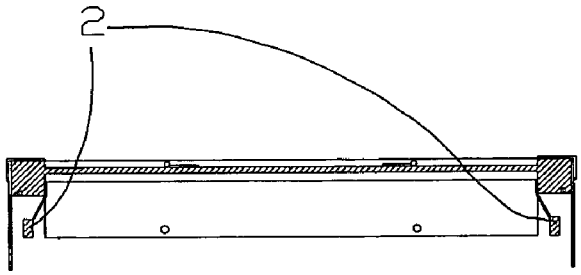
FIG. 2D is a D—D sectional view illustrating the folding panels in a second position according to the preferred embodiment of the present invention.
Figure 3A:
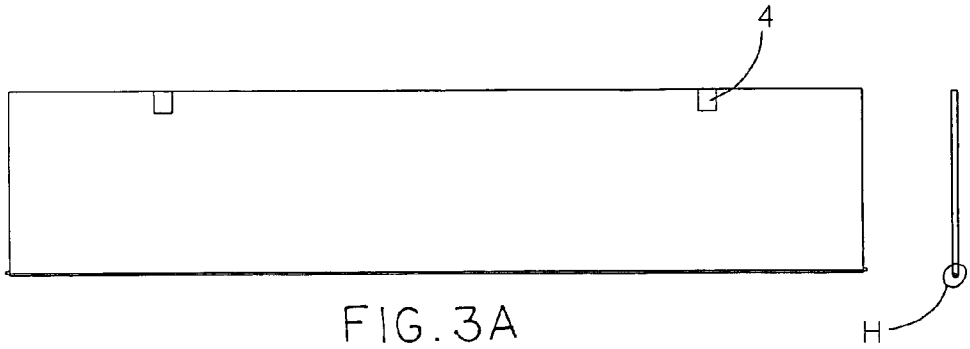
FIG. 3A is a front view of the sub-panel F of the side panel according to the preferred embodiment of the present invention.
Figure 3B:
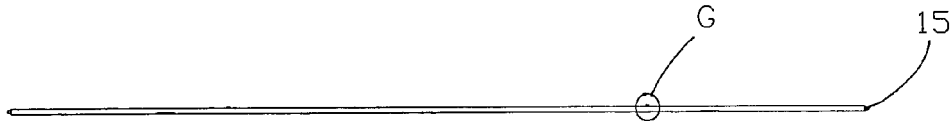
FIG. 3B is a top view of the sub-panel F of the side panel according to the preferred embodiment of the present invention.
Figure 3C:
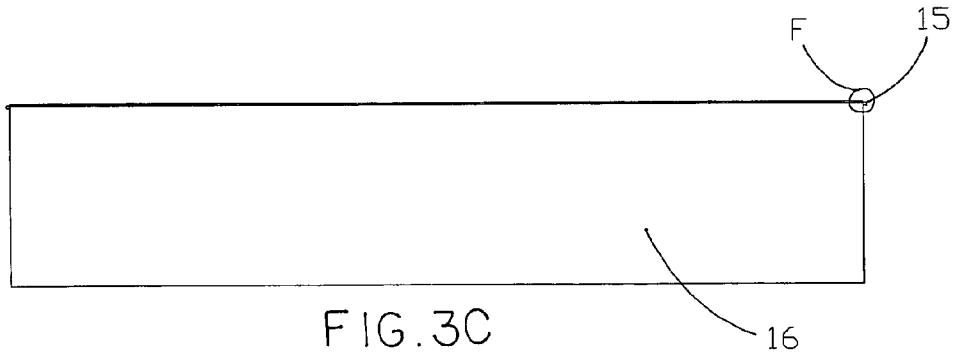
FIG. 3C is a rear view of the sub-panel F of the side panel according to the preferred embodiment of the present invention.
Figure 3D:
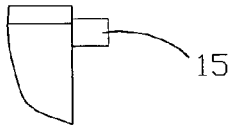
FIG. 3D is a partially enlarged view showing the sub-panel F of the side panel according to the preferred embodiment of the present invention.
Figure 3E:
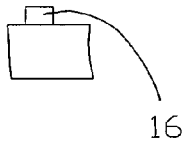
FIG. 3E is another partially enlarged view showing the sub-panel F of the side panel according to the preferred embodiment of the present invention.
Figure 3F:
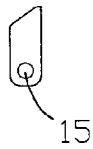
FIG. 3F is another partially enlarged view showing the sub-panel F of the side panel according to the preferred embodiment of the present invention.

Referring to FIGS. 1 to 8C of the drawings, a foldable container according to the preferred embodiment of the present invention is illustrated. The foldable container comprises a box-shaped container body which comprises a base panel D, a front folding panel A, a rear folding panel B, two side panels E, F and a top panel C, wherein the front folding panel A and the rear folding panel B are coupled with the base D through a folding arrangement such that the front folding panel A and rear folding panel B are capable of overlappedly folding on the base panel D. According to the present invention, each of the front and rear folding panels A, B has a second load-carrying structure and the base panel D has a first load-carrying structure to engage with the second load-carrying structure such that the front and rear folding panels A, B are adapted to fold between an unfolded position and a folded position. Accordingly, the second load-carrying structure comprises an elongated inserter 13 transversely and integrally extended along a lower edge of each of the front and rear folding panels A, B. The first load-carrying structure has an elongated retention slot 19, which is sized and shaped corresponding to the inserter 13, formed along each corresponding side of the base panel D. In which, at the unfolded position, the inserter 13 is slidably inserted into the respective retention slot 19 such that the front and rear folding panels A, B are mounted at two opposite sides of the base panel D. In addition, each of the inserters 13 has a plurality of fixing holes 24 spacedly formed thereon. The base panel D has a plurality of bottom mounting holes 11 spacedly formed on a bottom side and a plurality of lateral mounting holes 13 formed on a peripheral side edge wherein the bottom mounting holes 11 and the side mounting holes 13 are sized corresponding to the fixing holes 24 of the inserter 13. Accordingly, when the foldable container is in the unfolded position that the inserter 13 is slidably inserted into the respective retention slot 19, the fixing holes 24 are aligned with the bottom mounting holes 11 respectively, wherein a fastening element, such as screw and bolt, is used to lock up the inserter 13 at the retention slot 19 through the fixing hole 24 and the bottom mounting hole 11 so as to lock up the front and rear folding panels A, B at two sides of the base panel D. In which, when the foldable container is in the folded position that the inserter 13 is overlapped on the side edge of the base panel D, the fixing holes 24 are aligned with the lateral mounting holes 13 respectively, wherein the fastening element is used to overlappedly lock up the front and rear folding panels A, B on the base panel D through the fixing hole 24 and the lateral mounting hole 13. It is worth to mention that the side panels and the top panels C are folded to overlappedly dispose between the base panel D and the front and rear folding panels A, B when the foldable container is in the folded position. Each of the front and rear folding panels A, B further comprises two braces 31 provided at two side edges thereof respectively, wherein at least a lifting hole 1 is formed on a top side of the brace 31. It is noted that the structure of the lifting hole 1 on the brace 31 is as same as the conventional lifting holes applicable to shipping containers, so that the conventional hanger could be used for moving the foldable container of the present invention. There is a second set of lifting holes 9*a* provided at the outer side of each of the front and rear folding panels A, B, the fourth set and fifth set of lifting holes 9*b*, 9*c* respectively defined on the left lower portion and the right lower portion of each of the front and rear folding panels A, B. Therefore, when the foldable container is in the folded position that the second lifting holes 9*a* are upwardly oriented, the folded foldable container can be lifted up and transported by the conventional hanger through the lifting holes 9*a*, 9*b*, 9*c*. Each of the front and rear folding panels A, B further comprises two folding posts 2 rotatably mounted at two outer side edges respectively, wherein the folding posts 2 are folded rotatably to outwardly extend from the respective folding panel A, B, so as to support the weight of the top panel C when the foldable container is folded at the unfolded position. As shown in FIG. 1E, the folding posts 2 are folded rotatably to overlap on the respective folding panel A, B when the foldable container is folded at the folded position.

Each of the front and rear folding panels A, B has two sliding panels 51 formed at two outer sides of the inserter 13 wherein a sliding groove 5 is formed on each of the sliding panels 51, wherein the base panel D has four slider protrusions 20 outwardly extended from two sides of the retention slot 19 to slidably engage with the sliding grooves 5 so as to substantially guide the inserter 13 to slidably insert into the retention slot 19. In other words, the sliding engagement between the slider protrusion 20 and the sliding groove 5 ensure the inserter 13 to slidably insert into the retention slot 19 to connect the front and rear folding panels A, B with the base panel D. Furthermore, each of the front and rear folding panels A, B has two guiding grooves 12 provided at two inner sides thereof, which is respectively associated with the corresponding guiding member 14, 15 formed on the two side panels E, F. It is noted that a plurality of second guiding member 18 are provided at the side edges of the top panel C to slidably engage with the guiding grooves 12 respectively. Accordingly, the guiding members 14, 15 are slid along the guiding grooves 12 to overlap the two side panels E, F on the base panel D while the second guiding members 18 are slid along the guiding grooves 12 that the top panel C is downwardly slid to overlap on the side panels E, F so as to fold up the foldable container. Accordingly, the guiding grooves 12 are formed along the four braces 31 of the front and rear folding panels A, B. There are four third lifting holes defined on the top side of the top panel C, so that during a folding or unfolding process, the top panel C could be uplift to a predetermined height by a hanger. Certainly, the uplifted top panel will leave a room for maneuvering the front and rear folding panels A, B, i.e. the folding posts 2 are rotated outwardly for supporting the top panel C and inwardly for folding the foldable container. The foldable container further comprises an enhancement structure which has a first latch slot 7*b* formed on one of the side panels E, F and two spaced apart second and third latch slots 6, 7*a* formed on the side edge of the base panel D and comprises an elongated reinforcement arm G having a first end pivotally affixed to the respective side panel E, F at the first latch slot 7*b* and a second end detachably affixed to the base panel D at a position that when the foldable container is in the folded position, the second end of the reinforcement arm G is affixed at the second latch slots 6 and when the foldable container is in the unfolded position, the second end of the reinforcement arm G is affixed at the third latch slot 7*a*. In other words, the reinforcement arm G not only reinforces the structure of the foldable container at the unfolded position but also locks up the foldable container at the folded position. Therefore, the reinforcement arm G, which is an independent member, functions as a lock pillar detachably mounted to the foldable container to strength the overall structure of the foldable container, especially when the foldable container in an unfolded position. Each of the side panels comprises an upper side wall E and a lower side wall F pivotally coupled together in an edge-to-edge manner wherein the upper side wall E and the lower side wall F are overlapped with each other via a pivot means, such as a hinge, such that each of the side panels is adapted to be pivotally folded in half when the foldable container is folded in the folded position. Accordingly, the side panel could be further divided into a plurality of walls to further reduce the folding size thereof for simplifying the folding procedure. Furthermore, a plurality of retaining rails 17, preferably four retaining rails, spacedly formed on the base panel D. Each of the side panels further comprises a plurality of guiding members 16 spacedly formed thereon and arranged in such a manner that when the side panel is overlappedly folded on the base panel D, the guiding members 16 are slidably engaged with the retaining rails 17 such that the side panels are adapted to transversely slid on the base panel D to adjust the folding position of each of the side panels. In other words, when the upper and lower side walls E, F are overlappedly folded on the base panel D, the side panel is adapted to be slidably pushed inward along the retaining rail to fittingly lie on the base panel D. Therefore, the top panel C is downwardly slid to overlap on the upper and lower side walls E, F. Accordingly, each of the side panels further comprises four guiding members 14, 15 outwardly extended from the outer edges of the upper and lower side walls E, F to slidably engage with the guiding grooves 12 of the front and rear folding panels A, B such that when the guiding members 14, 15 slide along the guiding grooves 12 respectively, the upper and lower side walls E, F are guided to overlappedly fold on the base panel D. Furthermore, the retaining rail 17 could limit the moving direction of the opposed side panel and guarantee the opposed set of side panel constantly coupled with the base panel D. According to the present invention, there is a plurality of stacking holes 22 provided at both the base panel D and the folding panels, so that the stacked container could be affixed in position. It is noted that all edges between the base panel D, the front and rear folding panels A, B, the side panels, and the top panel C are sealed by sealing member 35, such as elastic rubber, for ensuring the foldable container could be well sealed during the applications.

According to the present invention, the retention slot 19 could be defined at a middle position of a side edge of the base panel D, or defined at a lower position of such base panel D to form a U-shaped slot. Or otherwise, the base panel D could be embodied as a flat panel, the inserter 13 is directly inserted into the bottom portion of the base panel D. In real applications, the top panel C and the side panels E, F could be detached from the container to form an open style three-piece container. The sliding panels 51 could be positioned at a bottom side of the base panel D; the sliding panels 51 includes a hinge having a first blade affixed to the inserter 13, and a second blade embedded into a sliding groove disposed within the retention slot 19 of the base panel D, wherein the second blade is capable of sliding with respect to the base panel D.

Alternatively, the inserter 13, as a second embodiment, can be constructed to have a plurality of inserting portions and the retention slot 19 has a plurality of slot portions for the inserting portions of the inserter 13 slidably inserting thereinto respectively in a detachably attaching manner, so as to detachably mount the front and rear folding panels A, B to the base panel D. The side panel is unitarily designed comprising a pair of guiding members 14, 15, and a curved guiding groove 12 defined on the two folding panels A, B, wherein the guiding member 15 is adapted to be sliding along the curved guiding groove 12. Alternatively, the inserter 13 could be formed on the base panel D, and the retention slot 19 are provided at the folding panel A, B instead for achieving the same effect.

Accordingly, the present invention introduces a folding and unfolding process of such foldable container. In case of a foldable container is to be detached, the folding process comprises the following steps.

Firstly, either first or second end of the reinforcement arms is detached from the foldable container and remove the fastening device, such as screw-bolts fastening means, between the front and rear folding panels A, B and the base panel D. Then, lift up top panel C through four of the third lifting holes and retract the folding posts 2 of the front and rear folding panels A, B. Therefore, the side panels are free to fold on the base panel D by folding the side panels E, F downwardly along the guiding rail 12 on the brace 31 of the front and rear folding panels A, B until the side panels E, F are overlapped together on the base panel. Then, move the overlapped side panel E, F towards the central portion of the base panel D along the third retaining rail 17 and slidably drop down the top panel C along the guiding rail 12 on two sides of the folding panel to overlap the base panel D. The inserters 13 are pulled out from the retention slots 19 respectively to detach the front and rear folding panels A, B from the base panel D, such that the front and rear folding panels A, B are overlappedly folded on the base panel D at a position that the inserters 13 are overlapped on the side edges of the base panel D respectively. When the fixing holes 24 are aligned with the lateral mounting holes 13 respectively, the fastening element is used to overlappedly lock up the front and rear folding panels A, B on the base panel D through the fixing hole 24 and the lateral mounting hole 13. Lastly, by re-attaching the reinforcement arms G to the foldable container, the foldable container is securely locked up at the folded position.

It is noted that the folding posts 2 could be replaced by other supporting means, such as shoe panel being pivotally connected with the front and rear folding panel, wherein the shoe panel could be turned horizontally with respect to the base panel D. In case the container is unfolded, the shoe panel outwardly turned to support the top panel C, while the container is folded, the shoe panel is turned inwardly to be received under the projected top edge of the folding panel. Alternatively, the folding posts 2 could be embodied as supporting means received within the groove of the folding panel, and the edge of the top panel is well received with the groove too so as to be propped by such supporting means. Or otherwise, the upright post are directly connected with the base panel D, wherein the base panel D comprises a rotatable axis, in the folded position, the upright post is received within the groove of the base panel, in the unfolded position, the upright post is retracted and extended out from the base panel to support the top panel C. Vice versa, the assembling process for preparing such foldable container is just reversing above steps.

Figure 10:
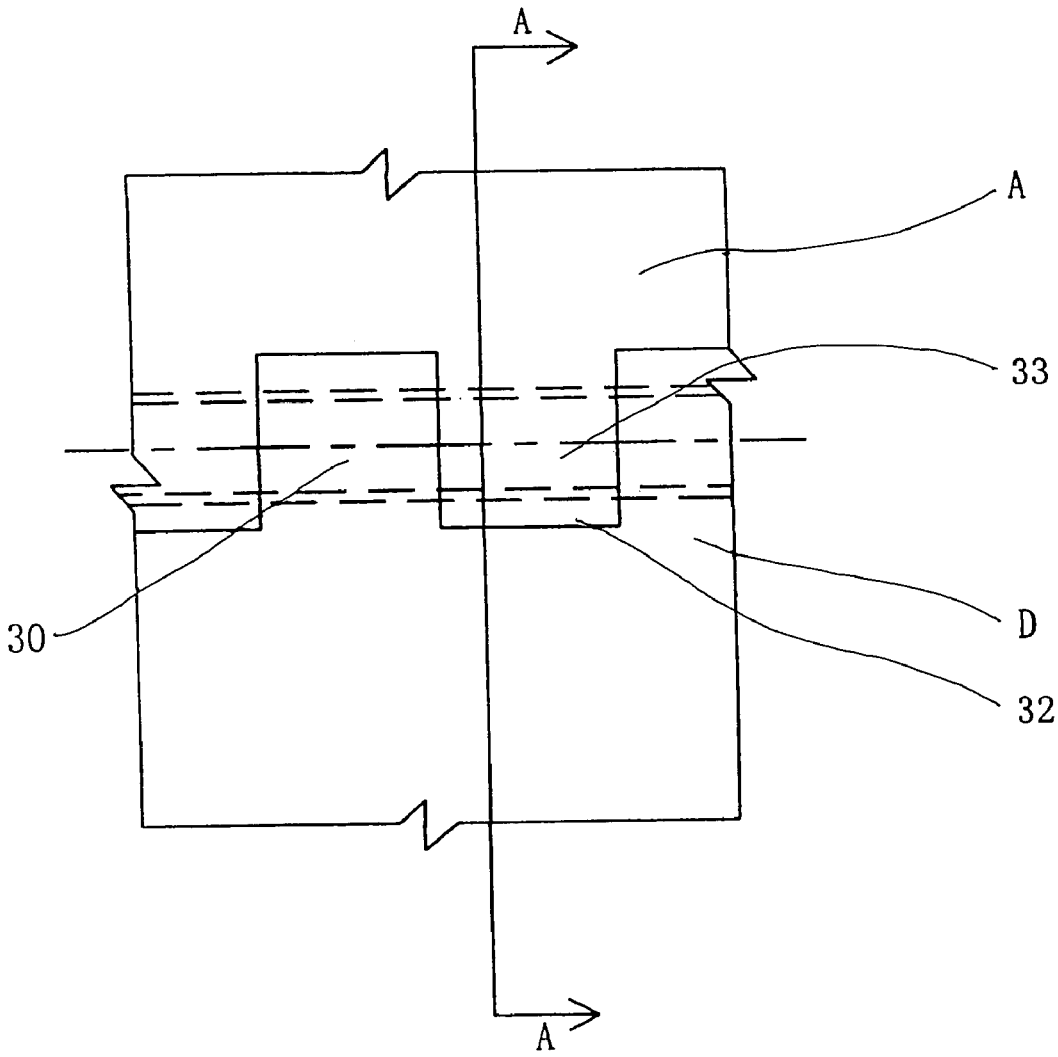
FIG. 10 is a X—X sectional view showing the coupling means of the foldable container according to the third embodiment of the present invention.
Figure 11:
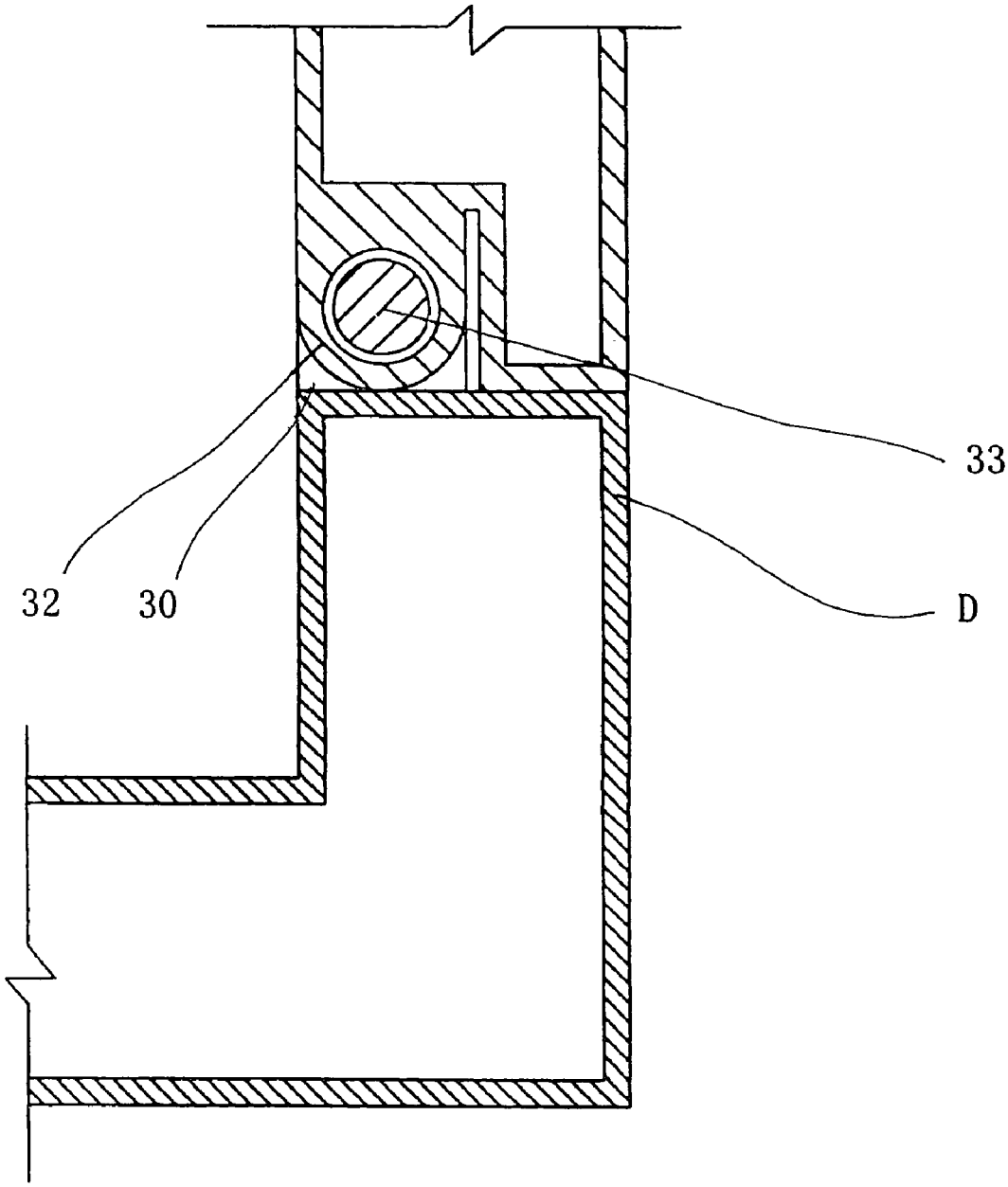
FIG. 11 is an A—A sectional view showing the coupling means of the foldable container according to the third embodiment of the present invention.
Figure 12:
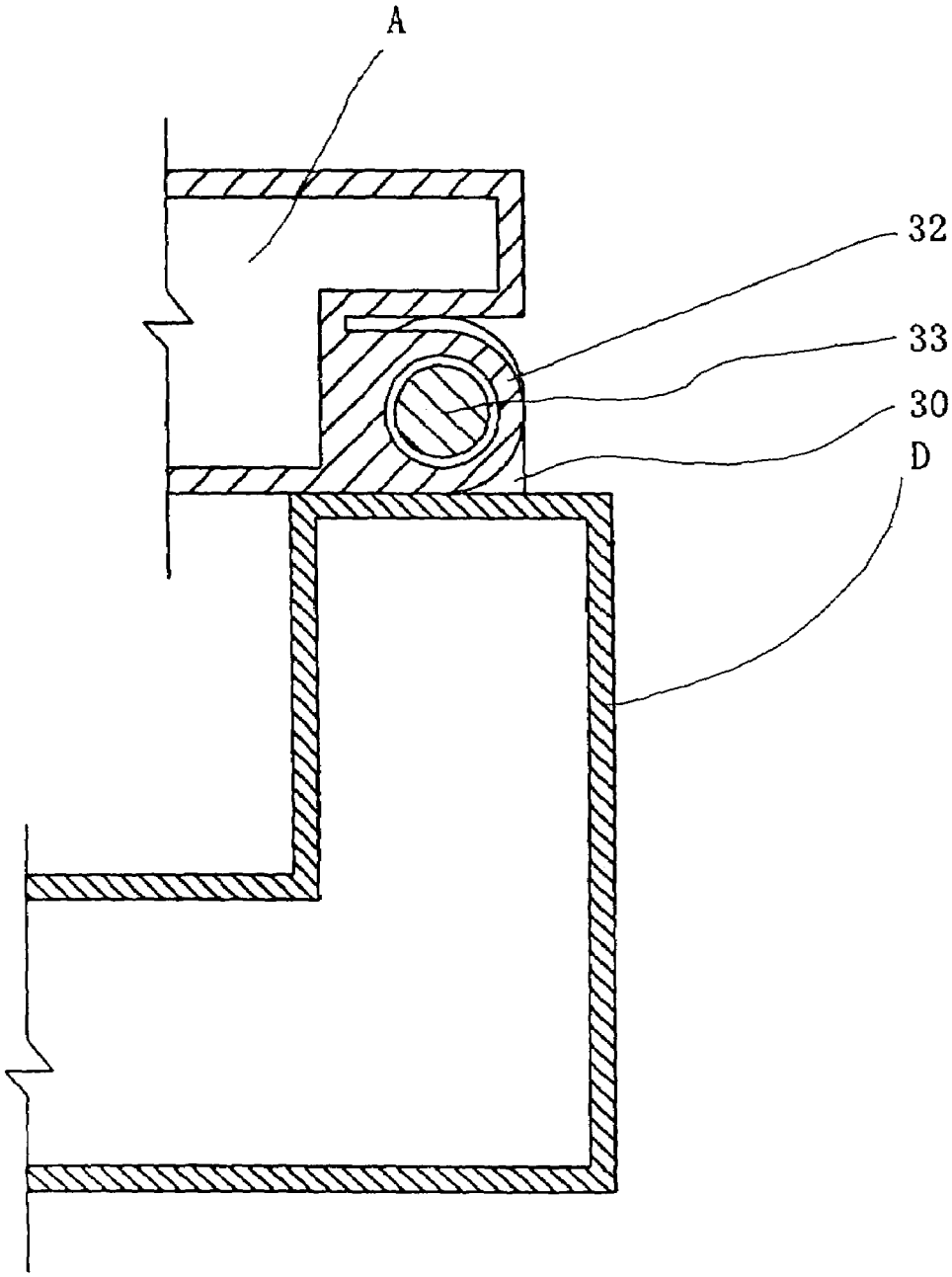
FIG. 12 is a front view showing the coupling means of the foldable container according to the third embodiment of the present invention.

Referring to FIGS. 10 to 12, a third embodiment of the foldable container according to the present invention is illustrated. The front and rear folding panels A, B are pivotally connected to the base panel D via a pivot hinge. The pivot hinge comprises a plurality of first engaging sleeves 32 are formed along the bottom edge of each of the front and rear folding panels A, B, and a second engaging sleeves 30 are correspondingly provided at the two sides of the base panel D, wherein the first and second engaging sleeves 32, 30 are alignedly engaged with each other. A supporting shaft 33 is slidably inserted into the first and second engaging sleeves 32, 30 to pivotally connect each of the front and rear folding panels A, B with the base panel D. It is noted that the heights of different side panels are varied for facilitating the folding and unfolding process. Accordingly, the top panel C could be hingedly coupled with the folding panels and side panels. There are pin holes formed on the top panel, and the side panels and folding panels are fastened to the base panel D through pins.

Accordingly, the assembling and disassembling process of such foldable container comprises the steps of releasing the pin from pin holes; folding the top panel C with respect to the folding panel; folding the side panels with respect to the base panel D; and folding the rear and front folding panels A, B.

Figure 9:
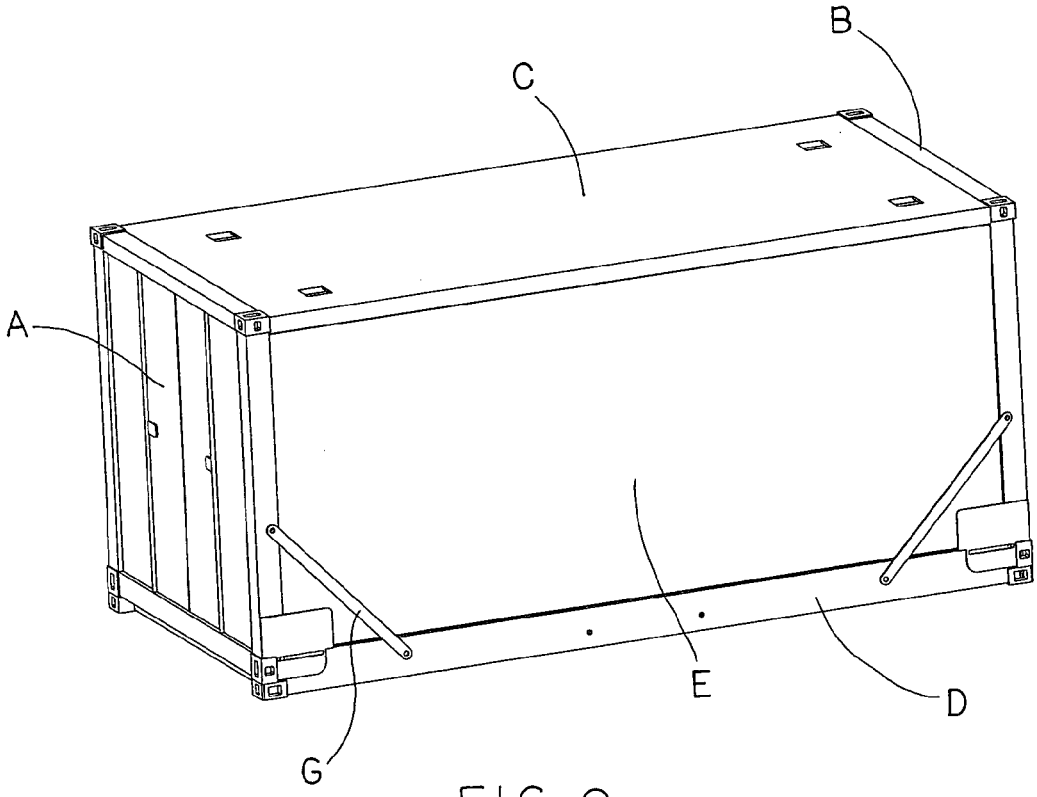
FIG. 9 is a perspective view showing the base panel is unfolded according to the second embodiment of the present invention.

Referring to FIG. 9, a fourth embodiment of the foldable container according to the present invention is illustrated, the side panels are integrally formed, and the guiding member 15 are correspondingly mated with curved guiding groove 12 formed on the folding panel.

According to the fifth embodiment of the present invention, a latch member 36 is embedded into a groove defined on the corner of the base panel D, and the latch slot is defined on the bottom side of each of the front and rear folding panels A, B. It is noted that latch slots are functioned as lifting holes as well, i.e. the fourth lifting holes 9*b*. Therefore, there is no inserter 13 and the sliding panel 51 mechanism is needed in this embodiment. And the first load-carrying arrangement is the groove formed on the base panel corner, and the second load-carrying arrangement has the latch slots formed on the bottom side of the front and rear folding panels A, B. Meanwhile, the latch member 36 is functioned as the third load-carrying arrangement to withstand the weight.

The foldable container according to the sixth embodiment of the present invention is illustrated. The base panel D further comprises a plurality of latch members 36 outwardly extended from two side edges and each of the front and rear folding panels A, B contains a plurality of latch holes 9*d* and arranged in such a manner that when the front and rear folding panels A, B are mounted to the base panel D, the latch members 36 are slidably insert into the latch holes 9*d* to retain the front and rear folding panels A, B in position.

Figure 4A:
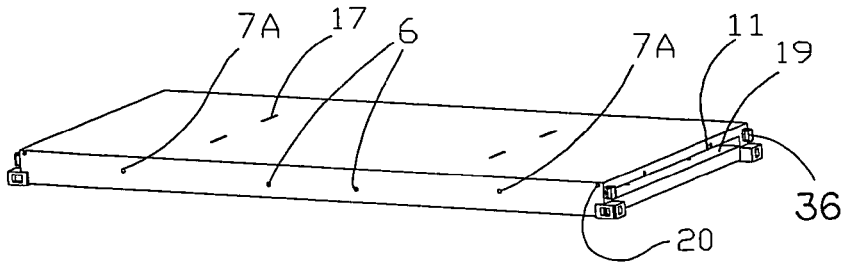
FIG. 4A is a perspective view of the base panel D according to the sixth embodiment of the present invention.
Figure 4B:
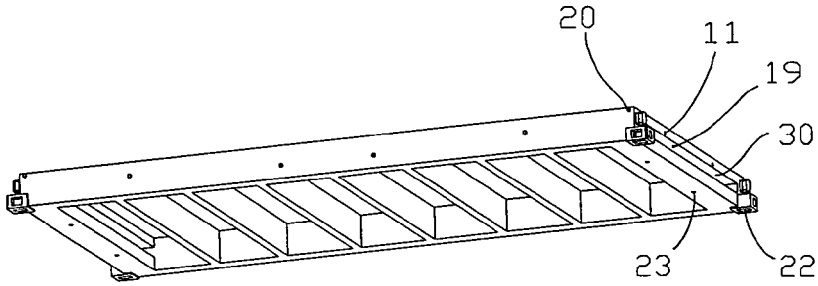
FIG. 4*b* is another perspective view of the base panel D according to the sixth embodiment of the present invention.
Figure 4C:
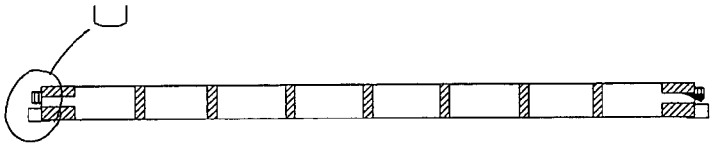
FIG. 4*c* is a I—I sectional view showing the base panel D according to the sixth embodiment of the present invention.
Figure 4D:
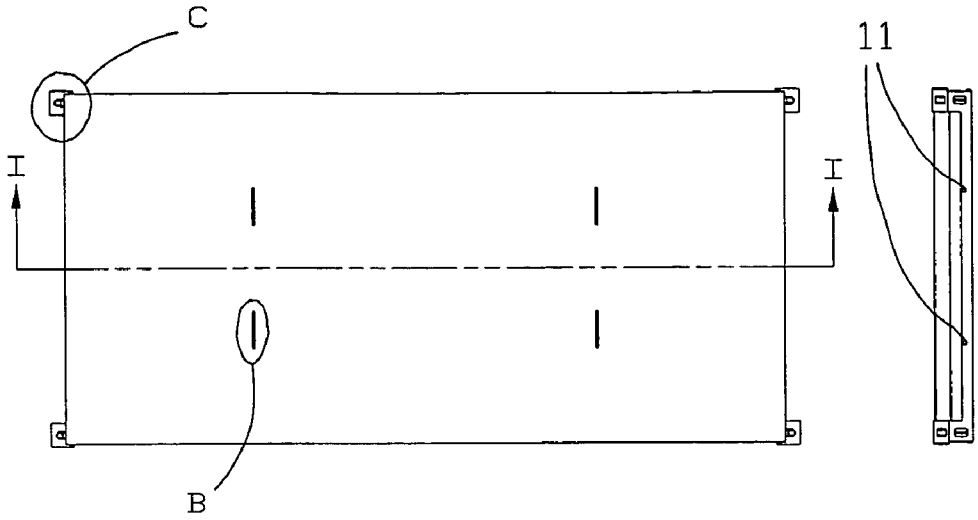
FIG. 4D is a front view of the base panel D according to the sixth embodiment of the present invention.
Figure 4E:
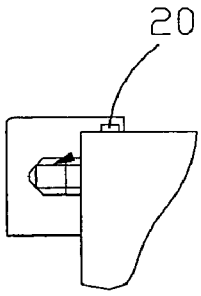
FIG. 4E is a partially enlarged view showing the base panel according to the sixth embodiment of the present invention.
Figure 4F:
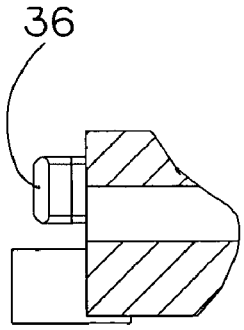
FIG. 4F is a partially enlarged view showing the base panel according to the sixth embodiment of the present invention.
Figure 4G:
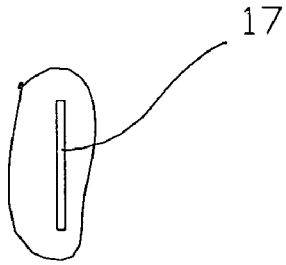
FIG. 4G is another partially enlarged view showing the base panel according to the sixth embodiment of the present invention.
Figure 4H:
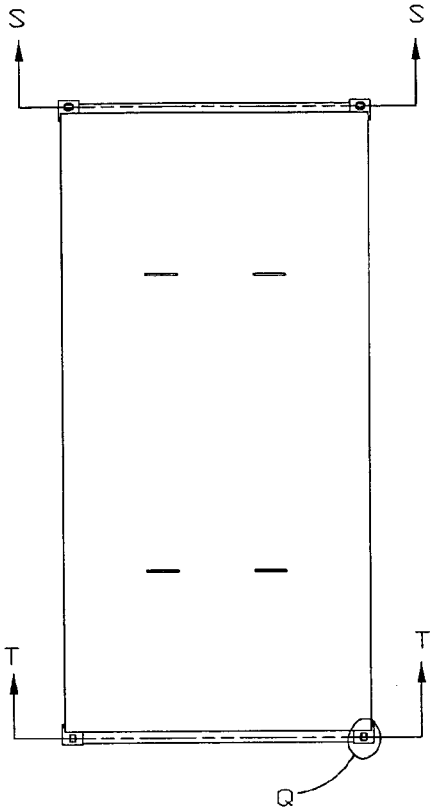
FIG. 4H is a front view of the base panel according to the fifth embodiment of the present invention.
Figure 4K:
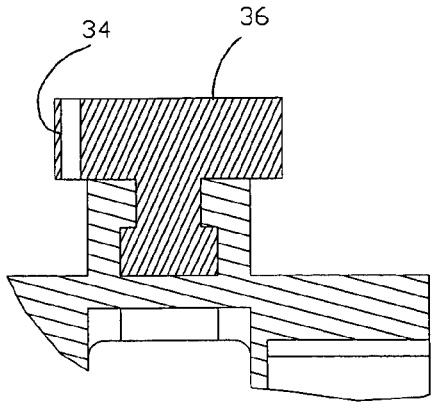
FIG. 4K is a partial enlarged view P showing the base panel according to the fifth embodiment of the present invention.
Figure 4L:
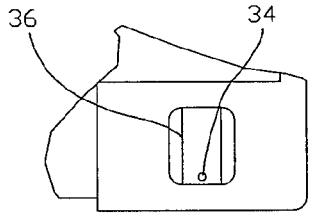
FIG. 4L is a partial enlarged view Q showing the base panel according to the fifth embodiment of the present invention.
Figure 4I:
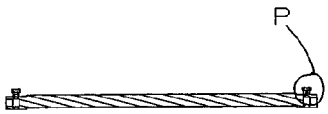
FIG. 4I a S—S sectional view of the base panel according to the fifth embodiment of the present invention.
Figure 4J:
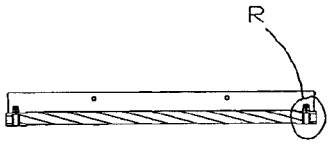
FIG. 4J is a T—T sectional view of the base panel according to the fifth embodiment of the present invention.
Figure 4M:
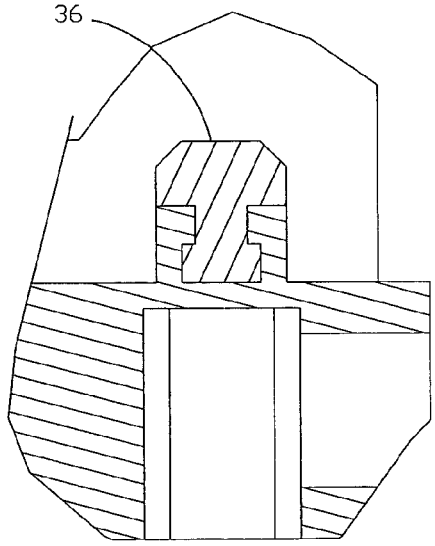
FIG. 4M is a partial enlarged view showing the latch member according to the fifth preferred embodiment of the present invention.
Figure 5A:
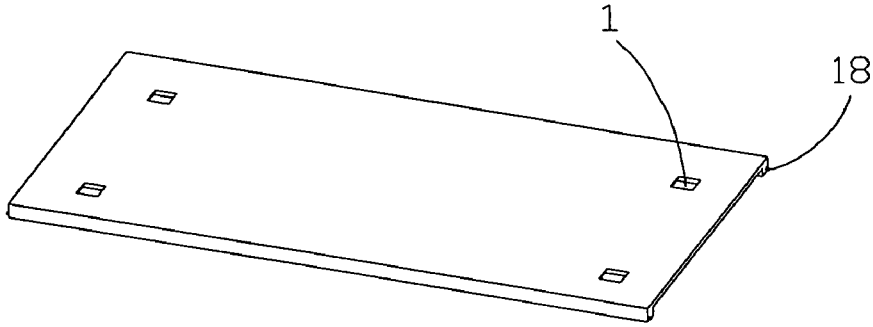
FIG. 5A is a perspective view of the top panel of the present invention.
Figure 5B:
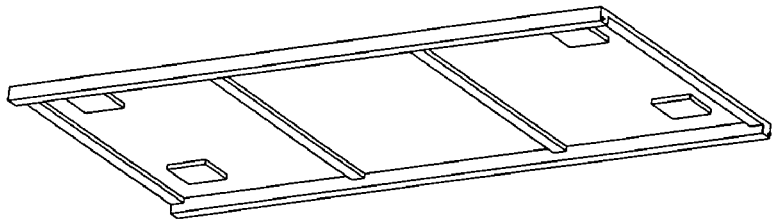
FIG. 5B is another perspective view of the top panel of the present invention.
Figure 5C:
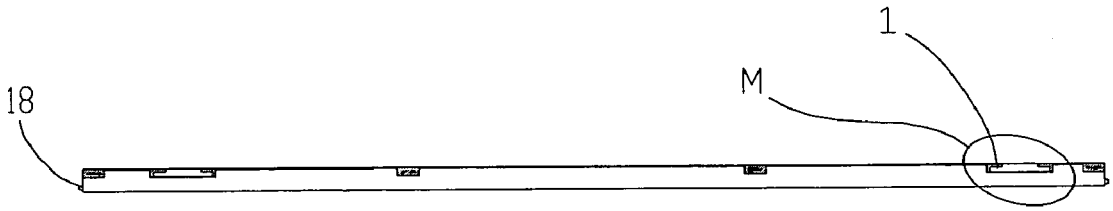
FIG. 5C is a L—L sectional view of the top panel of the present invention.
Figure 5D:
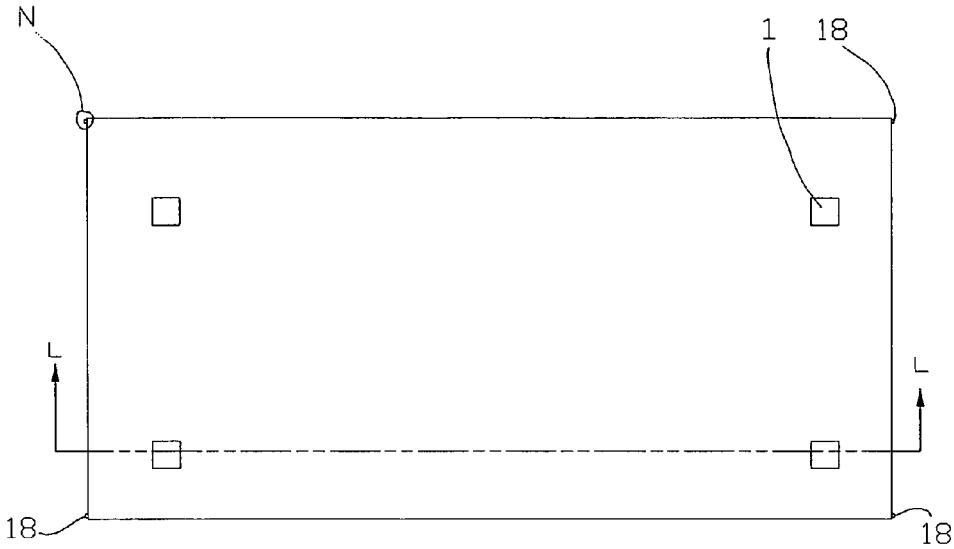
FIG. 5D is a front view of the top panel of the present invention.
Figure 5F:
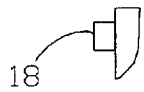
FIG. 5F is another partially enlarged view showing the top panel of the present invention.
Figure 5E:
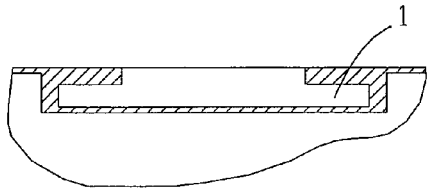
FIG. 5E is a partially enlarged view showing the top panel of the present invention.
Figure 7A:
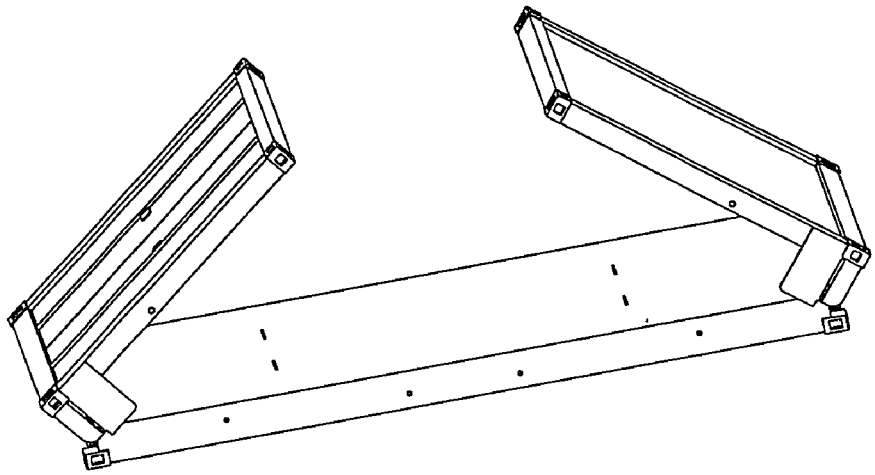
FIG. 7A is a perspective view of the foldable container according to the present invention.
Figure 7B:
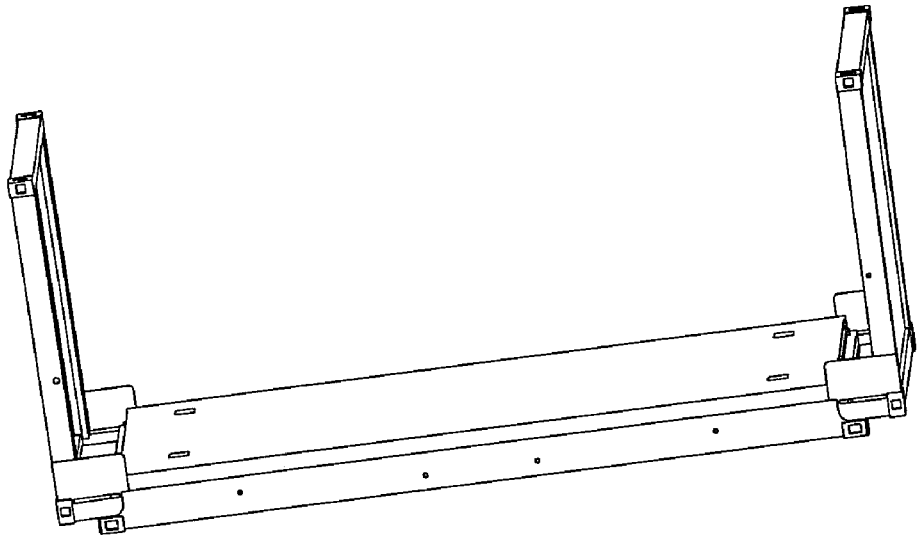
FIG. 7B is another perspective view of the foldable container according to the present invention.
Figure 7C:
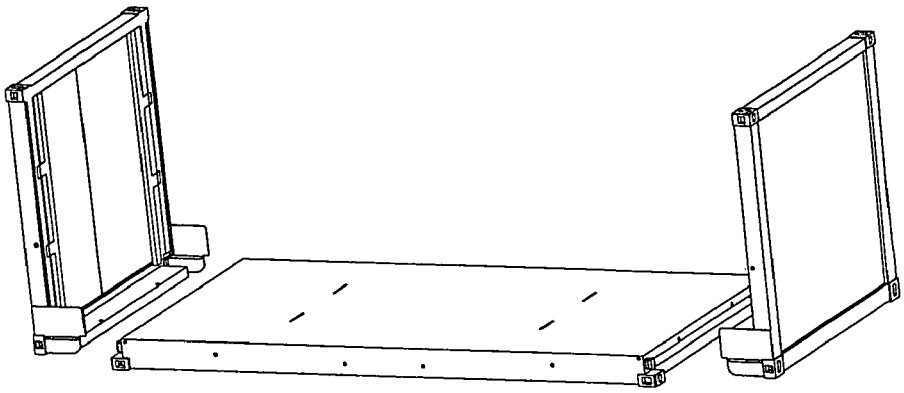
FIG. 7C is a partial perspective view of the foldable container according to the present invention.
Figure 7D:
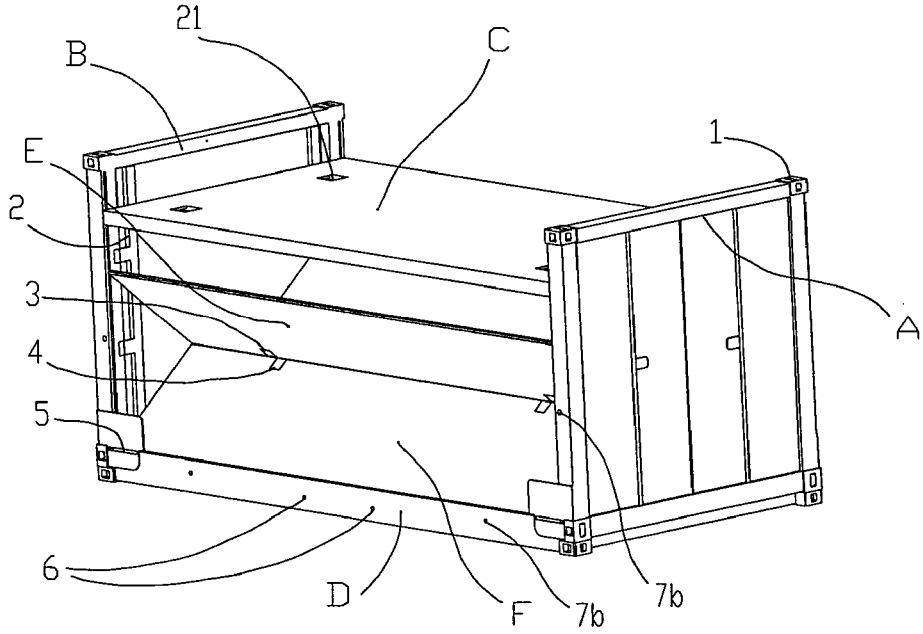
FIG. 7D is a perspective view showing the foldable container unfolded according to the present invention.
Figure 7E:
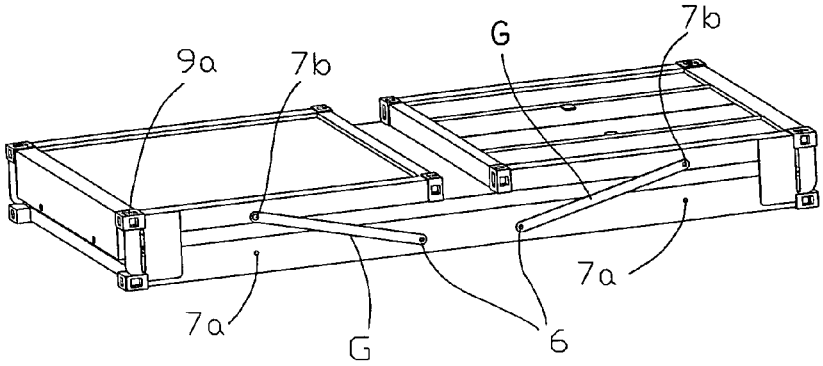
FIG. 7E is a perspective view showing the foldable container folded according to the present invention.
Figure 7F:
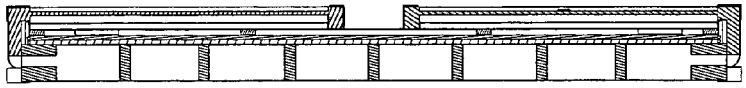
FIG. 7F is a U—U sectional view showing the foldable container folded according to the present invention.
Figure 7G:
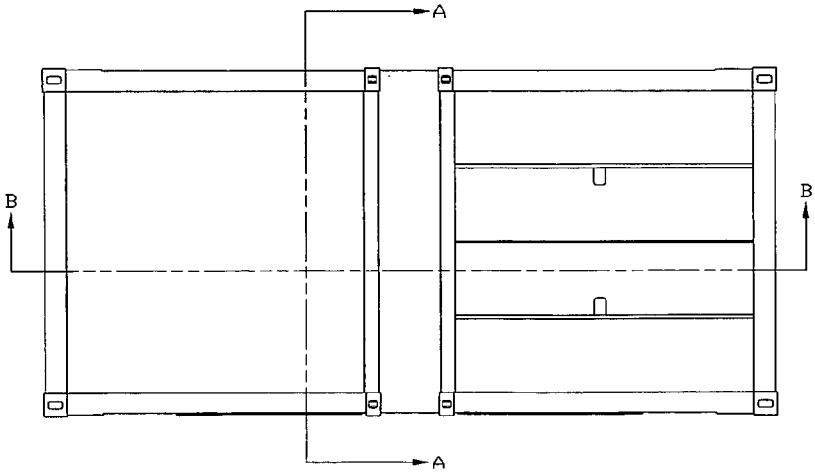
FIG. 7G is a front view showing the foldable container folded according to the present invention.
Figure 7H:
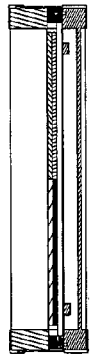
FIG. 7H is a V—V sectional view showing the foldable container folded according to the present invention.
Figure 8A:
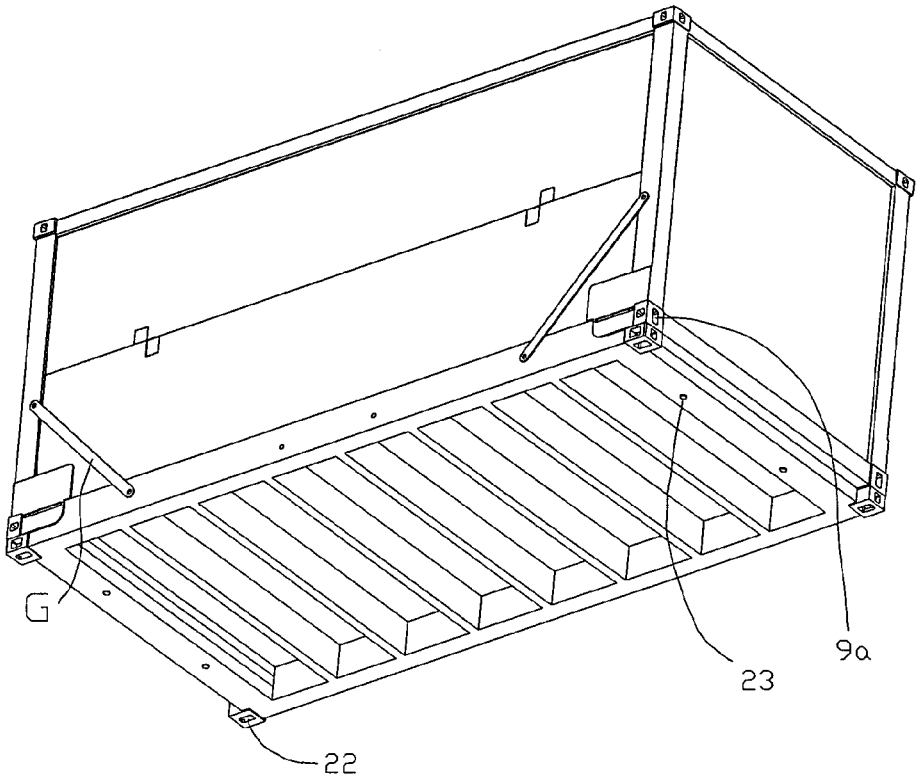
FIG. 8A is perspective view showing the foldable container unfolded according to the present invention.
Figure 8B:
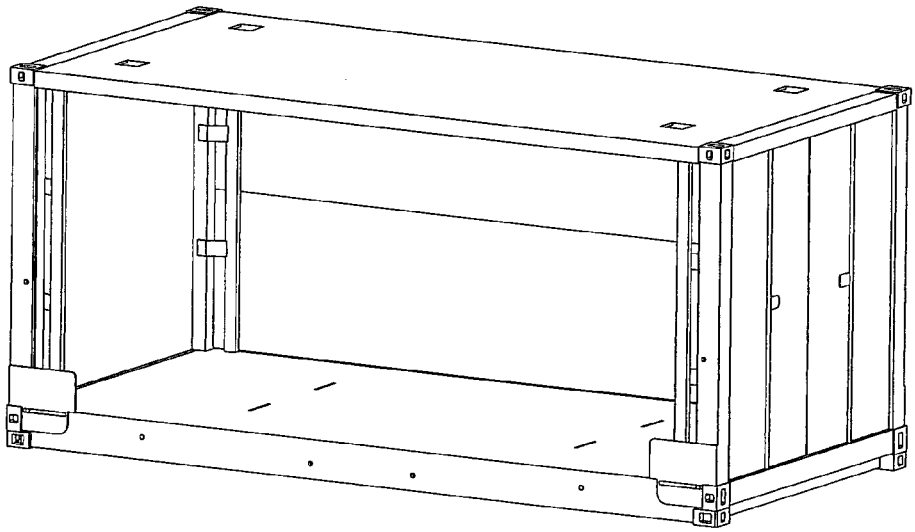
FIG. 8B is a perspective view showing the interior of the foldable container according to the present invention.
Figure 8C:
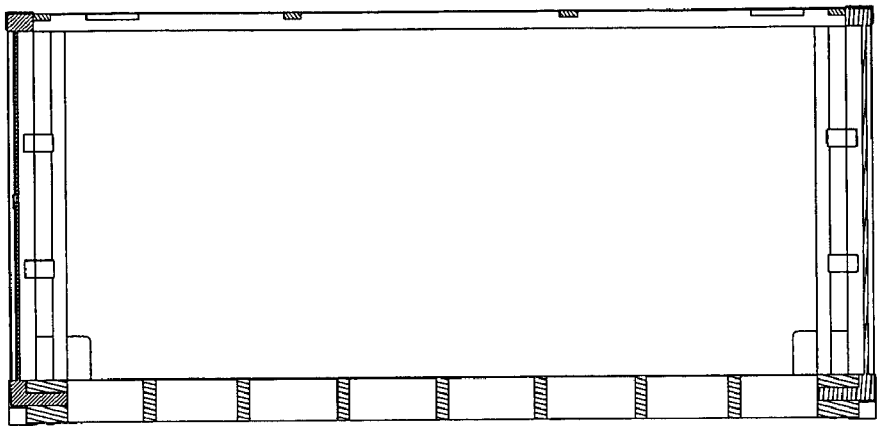
FIG. 8C is a W—W sectional view showing the foldable container unfolded according to the present invention.
Figure 8D:
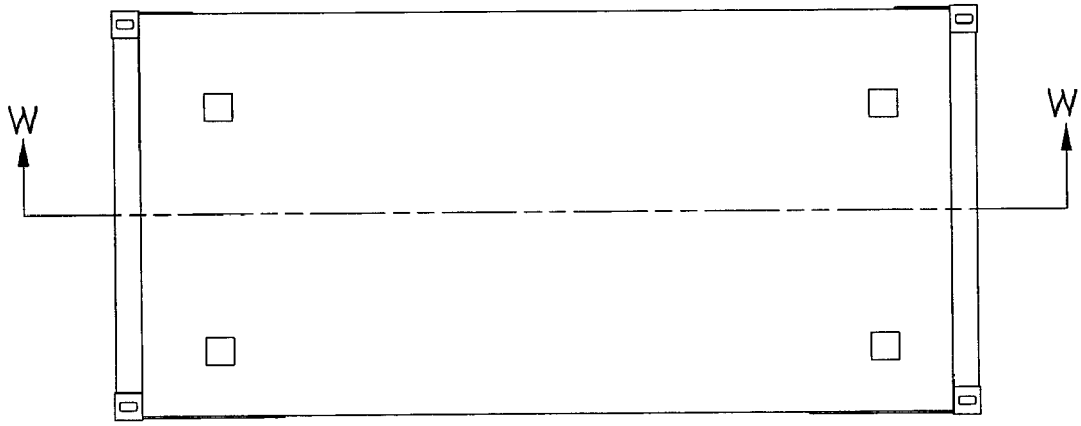
FIG. 8D is a top view of the foldable container according to the present invention.
Figure 8E:
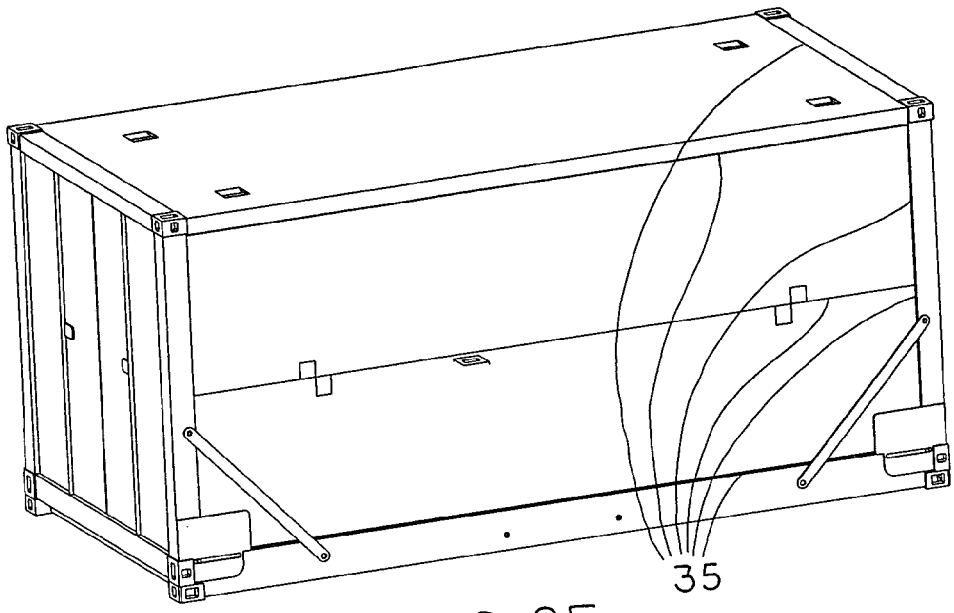
FIG. 8E is a perspective view of the foldable container according to the present invention.

Therefore, when the foldable container is unfolded, the latch configuration would enable the base panel D tightly coupled with the front and rear folding panels A, B in position. As a result, the fixing holes 24 mentioned in the first preferred embodiment could be eliminated. As shown in FIG. 4K to FIG. 4M, a groove is formed on the base panel D, and the latch member has a first end moveably affixed within the groove, and a second end being embodied as a rectangle body being rotatably received into the latch slot 9*d* provided to the folding panel A, B. It is noted that a pin hole 34 is provided at the rectangle body end for locking up the latch member 36.

Conclusively, the foldable containers of the present invention could be automatically stacked by suspending means, such as the hanger widely available in the harbor no matter whether foldable container is in a folded position or in an unfolded position. The volume of folded container occupies only one fifth of the initial volumetric space of a conventional container, therefore the storage space for stacking such foldable containers are significantly reduced and the shipping costs could be dramatically saved.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable container, comprising:

a box shaped container body which comprises a base panel, a top panel, two side panels, a front folding panel, and a rear folding panel; and a folding arrangement which has two elongated retention slots formed at two outer sides of said base panels respectively and comprises two inserters outwardly extended from bottom edges of said front and rear folding panels respectively, wherein said front and rear panels folding are adapted to fold between an unfolded position and a folded position, wherein at said unfolded position, said inserters are slidably inserted into said retention slots respectively to detachably mount said front and rear folding panels to said base panel, and at said folded position, said inserters are slidably detached from said retention slots respectively such that said front and rear folding panels are overlapped on said base panel while said side panels and said top panels are folded to overlappedly dispose between said base panel and said front and rear folding panels, wherein said folding arrangement further has a plurality of fixing holes spacedly formed on each of said inserters, a plurality of bottom mounting holes spacedly formed on a bottom side of said base panel and a plurality of lateral mounting holes formed on a peripheral side edge of said base panel, said folding arrangement further comprising a plurality of fastening elements arranged in such a manner that when said fixing holes are aligned with said bottom mounting holes respectively, said fastening elements lock up said front and rear folding panels with said base panel through said fixing holes and said bottom mounting holes so as to lock up said foldable container at said unfolded position, and when said fixing holes are aligned with said lateral mounting holes respectively, said fastening elements lock up said front and rear folding panels with said base panel through said fixing holes and said lateral mounting holes so as to lock up said foldable container at said folded position.

2. The foldable container, as recited in claim 1, wherein each of said front and rear folding panels comprises two braces provided at two side edges thereof respectively, wherein a first lifting hole is formed on top of each of said braces and a second lifting hole is formed at a bottom end of each of said braces such that said foldable container is adapted to be lifted up and transported via said first lifting holes when said foldable container is in unfolded position and via said second lifting holes when said foldable container is in folded position.

3. The foldable container, as recited in claim 1, wherein each of said front and rear folding panels further comprises two folding posts rotatably mounted along two sides thereof, wherein said folding posts are folded rotatably to outwardly extend from said respective folding panel to support said top panel when said foldable container is folded at said unfolded position, wherein said folding posts are folded rotatably to overlap on said respective folding panel when said foldable container is folded at said folded position.

4. The foldable container, as recited in claim 2, wherein each of said front and rear folding panels further comprises two folding posts rotatably mounted along two sides thereof, wherein said folding posts are folded rotatably to outwardly extend from said respective folding panel to support said top panel when said foldable container is folded at said unfolded position, wherein said folding posts are folded rotatably to overlap on said respective folding panel when said foldable container is folded at said folded position.

5. The foldable container, as recited in claim 2, wherein each of said front and rear folding panels has two sliding panels formed at two outer sides of said inserter and a sliding groove formed on each of said sliding panels, wherein said base panel has four slider protrusions outwardly extended from two sides of said retention slot to slidably engage with said sliding grooves so as to substantially guide and ensure said inserter to slidably insert into said retention slot to connect the front and rear folding panels with said base panel.

6. The foldable container, as recited in claim 4, wherein each of said front and rear folding panels has two sliding panels formed at two outer sides of said inserter and a sliding groove formed on each of said sliding panels, wherein said base panel has four slider protrusions outwardly extended from two sides of said retention slot to slidably engage with said sliding grooves so as to substantially guide and ensure said inserter to slidably insert into said retention slot to connect the front and rear folding panels with said base panel.

7. The foldable container, as recited in claim 4, wherein each of said side panels comprises an upper side wall and a lower side wall pivotally coupled together in an edge-to-edge manner, wherein said upper side wall and said lower side wall are overlapped with each other such that each of said side panels is pivotally folded in half when said foldable container is folded in said folded position.

8. The foldable container, as recited in claim 6, wherein each of said side panels comprises an upper side wall and a lower side wall pivotally coupled together in an edge-to-edge manner, wherein said upper side wall and said lower side wall are overlapped with each other such that each of said side panels is pivotally folded in half when said foldable container is folded in said folded position.

9. The foldable container, as recited in claim 2, wherein each of said side panels comprises an upper side wall and a lower side wall pivotally coupled together in an edge-to-edge manner, wherein said upper side wall and said lower side wall are overlapped with each other such that each of said side panels is pivotally folded in half when said foldable container is folded in said folded position, wherein each of said front and rear folding panels has two guiding grooves provided at two inner sides thereof, wherein each of said side panels has four guiding members outwardly extended from outer edges of said upper and lower side walls to slidably engage with said guiding grooves of said front and rear folding panels such that when said guiding members slide along said guiding grooves respectively, said upper and lower side walls are guided to overlapped fold on said base panel.

10. The foldable container, as recited in claim 7, wherein each of said front and rear folding panels has two guiding grooves provided at two inner sides thereof, wherein each of said side panels has four guiding members outwardly extended from outer edges of said upper and lower side walls to slidably engage with said guiding grooves of said front and rear folding panels such that when said guiding members slide along said guiding grooves respectively, said upper and lower side walls are guided to overlappedly fold on said base panel.

11. The foldable container, as recited in claim 8, wherein each of said front and rear folding panels has two guiding grooves provided at two inner sides thereof, wherein each of said side panels has four guiding members outwardly extended from outer edges of said upper and lower side walls to slidably engage with said guiding grooves of said front and rear folding panels such that when said guiding members slide along said guiding grooves respectively, said upper and lower side walls are guided to overlappedly fold on said base panel.

12. The foldable container, as recited in claim 9, wherein said top panel further comprises a plurality of second guiding member provided at side edges of said top panel to slidably engage with said guiding grooves respectively such that said top panel is dropped downwardly to overlap on said base panel along said guiding groove when said foldable container is in said folded position.

13. The foldable container, as recited in claim 10, wherein said top panel further comprises a plurality of second guiding member provided at side edges of said top panel to slidably engage with said guiding grooves respectively such that said top panel is dropped downwardly to overlap on said base panel along said guiding groove when said foldable container is in said folded position.

14. The foldable container, as recited in claim 11, wherein said top panel further comprises a plurality of second guiding member provided at side edges of said top panel to slidably engage with said guiding grooves respectively such that said top panel is dropped downwardly to overlap on said base panel along said guiding groove when said foldable container is in said folded position.

15. The foldable container, as recited in claim 11, further comprising an enhancement structure which has a first latch slot formed on one of said front and rear folding panels and two spaced apart second and third latch slots formed on a side edge of said base panel and comprises an elongated reinforcement arm having a first end pivotally affixed to one of said respective front and rear panels at said first latch slot and a second end detachably affixed to said base panel at a position that when said foldable container is in the folded position, said second end of said reinforcement arm is affixed at said second latch slots to lock up said foldable container at said folded position and when said foldable container is in said unfolded position, said second end of said reinforcement arm is affixed at said third latch slot to lock up said foldable container at said unfolded position.

16. The foldable container, as recited in claim 14, further comprising an enhancement structure which has a first latch slot formed on one of said front and rear folding panels and two spaced apart second and third latch slots formed on a side edge of said base panel and comprises an elongated reinforcement arm having a first end pivotally affixed to one of said respective front and rear panels at said first latch slot and a second end detachably affixed to said base panel at a position that when said foldable container is in the folded position, said second end of said reinforcement arm is affixed at said second latch slots to lock up said foldable container at said folded position and when said foldable container is in said unfolded position, said second end of said reinforcement arm is affixed at said third latch slot to lock up said foldable container at said unfolded position.

17. A foldable container, comprising:

a box shaped container body which comprises a base panel, a top panel, two side panels, a front folding panel, and a rear folding panel; and a folding arrangement which has two elongated retention slots formed at two outer sides of said base panels respectively and comprises two inserters outwardly extended from bottom edges of said front and rear folding panels respectively, wherein said front and rear panels are adapted to fold between an unfolded position and a folded position, wherein at said unfolded position, said inserters are slidably inserted into said retention slots respectively to detachably mount said front and rear folding panels to said base panel, and at said folded position, said inserters are slidably detached from said retention slots respectively such that said front and rear folding panels are overlapped on said base panel while said side panels and said top panels are folded to overlappedly dispose between said base panel and said front and rear folding panels, wherein each of said front and rear folding panels has two sliding panels formed at two outer sides of said inserter and a sliding groove formed on each of said sliding panels, wherein said base panel has four slider protrusions outwardly extended from two sides of said retention slot to slidably engage with said sliding grooves so as to substantially guide and ensure said inserter to slidably insert into said retention slot to connect the front and rear folding panels with said base panel.

18. A foldable container, comprising:

a box shaped container body which comprises a base panel, a top panel, two side panels, a front folding panel, and a rear folding panel; and a folding arrangement which has two elongated retention slots formed at two outer sides of said base panels respectively and comprises two inserters outwardly extended from bottom edges of said front and rear folding panels respectively, wherein said front and rear panels are adapted to fold between an unfolded position and a unfolded position, wherein at said unfolded position, said inserters are slidably inserted into said retention slots respectively to detachably mount said front and rear folding panels to said base panel, and at said folded position, said inserters are slidably detached from said retention slots respectively such that said front and rear folding panels are overlapped on said base panel while said side panels and said top panels are folded to overlappedly dispose between said base panel and said front and rear folding panels; and an enhancement structure which has a first latch slot formed on one of said front and rear folding panels and two spaced apart second and third latch slots formed on a side edge of said base panel and comprises an elongated reinforcement arm having a first end pivotally affixed to one of said respective front and rear folding panels at said first latch slot and a second end detachably affixed to said base panel at a position that when said foldable container is in the folded position, said second end of said reinforcement arm is affixed at said second latch slots to lock up said foldable container at said folded position and when said foldable container is in said unfolded position, said second end of said reinforcement arm is affixed at said third latch slot to lock up said foldable container at said unfolded position.

* * * * *